United States Patent [19]

Stemples

[11] Patent Number: 4,980,932

[45] Date of Patent: Jan. 1, 1991

[54] WATER SAVING DEVICE

[76] Inventor: Robert L. Stemples, 8220 Sargent Way, Bakersfield, Calif. 93311

[21] Appl. No.: 495,496

[22] Filed: Mar. 19, 1990

[51] Int. Cl.[5] ..... E03D 1/00

[52] U.S. Cl. ..... 4/415; 4/324; 4/366; 4/661; 137/441

[58] Field of Search ..... 4/362, 363, 370, 418, 4/324, 354, 661, 255, 366; 137/441

[56] References Cited

U.S. PATENT DOCUMENTS

| | | | |
|---|---|---|---|
| 926,787 | 7/1909 | Virklar | 137/441 |
| 1,164,892 | 12/1915 | Townsend | 4/255 |
| 1,525,334 | 2/1925 | Stengel | 137/436 |
| 1,609,337 | 12/1926 | Wotrous | 137/441 X |
| 1,787,601 | 1/1931 | Swanberg | 137/441 X |
| 2,087,503 | 7/1937 | Clemmons | 137/441 X |
| 2,683,462 | 7/1954 | Mutti | 137/441 X |
| 3,902,201 | 9/1975 | Bobo | 4/366 X |
| 4,038,708 | 8/1977 | Perrine | 4/415 |
| 4,145,775 | 3/1979 | Butler | 4/415 |
| 4,183,108 | 1/1989 | Hamilton | 4/354 |
| 4,266,304 | 5/1981 | Kohrs | 4/415 |
| 4,420,845 | 12/1983 | Antunez | 137/441 X |
| 4,764,996 | 8/1988 | Pino | 4/415 |

*Primary Examiner*—Henry K. Artis

*Attorney, Agent, or Firm*—I. Michael Bak-Boychuk

[57] ABSTRACT

A flow splitting valve assembly is inserted into the afterfill line of a conventional water closest ballcock valve, the valve assembly including adjustable valves for directing some of the afterfill flow into the watercloset. The adjustable valves provide means for selecting after fill flow rates at various supply pressures.

3 Claims, 3 Drawing Sheets

WATER SAVING DEVICE

BACKGROUND OF THE INVENTION

1. Field of the Invention

The present invention relates to water saving devices, and more particularly to adjustable flow splitting arrangements for controlling the amount of water directed into a toilet bowl.

2. Description of the Prior Art

In a typical household the toilet is provided with a holding tank in which a determined amount of water is accumulated after each use. In the course of this accumulation a part of the filling stream is diverted into the bowl itself, providing the liquid seal against gases and the like. This diversion of the filling stream is under the control of a ballcock mechanism and thus will vary from installation to installation. More precisely, the ballcock mechanism itself splits into two flows, one directed into the holding tank and the other through an afterfill tube into the bowl. Thus the supply water pressure at the ballcock determines, to a large extent, the amount of water diverted into the bowl. As result the water excess in the bowl is simply washed down the drain.

In the past various techniques were devised for controlling the afterfill flow into the toilet bowl. Exemplary such teachings are found in U.S. Pat. No. 4,145,775 to Butler and in U.S. Pat. No. 4,7864,996 to Pino. Each of these, while suitable for the purposes intended, relies on a restriction in the afterfill tube to reduce the flow therethrough. In consequence pressure variations in the supply vary the afterfill flow rate and an excess amount must therefore be allowed for effective bowl sealing.

Accordingly, a technique less dependent on the supply pressure for its flow is desired and it is one such technique that is disclosed herein.

SUMMARY OF THE INVENTION

Accordingly, it is the general purpose and object of the present invention to provide a flow splitting assembly insertable in the after fill circuit of a conventional ballcock.

Other objects of the invention are to provide a control arrangement for splitting the afterfill flow in a toilet.

Yet further objects of the invention are to provide a flow diversion mechanism conveniently installed into a ballcock assembly.

Briefly, these and other objects are accomplished within the present invention by providing a tee fitting conformed for mating with the afterfill tubing of a conventional toilet ball valve assembly and to a diverter tube at the third end. These portions of the fitting feeding the afterfill line and the diverter tube are each provided with a control valve adjustable to control the relative flows therethrough. Thus, the fitting provides for a controlled, diverted flow path into the holding tank of the toilet together with a control arrangement in the afterfill flow.

DESCRIPTION OF THE PREFERRED EMBODIMENT

Figure 1:
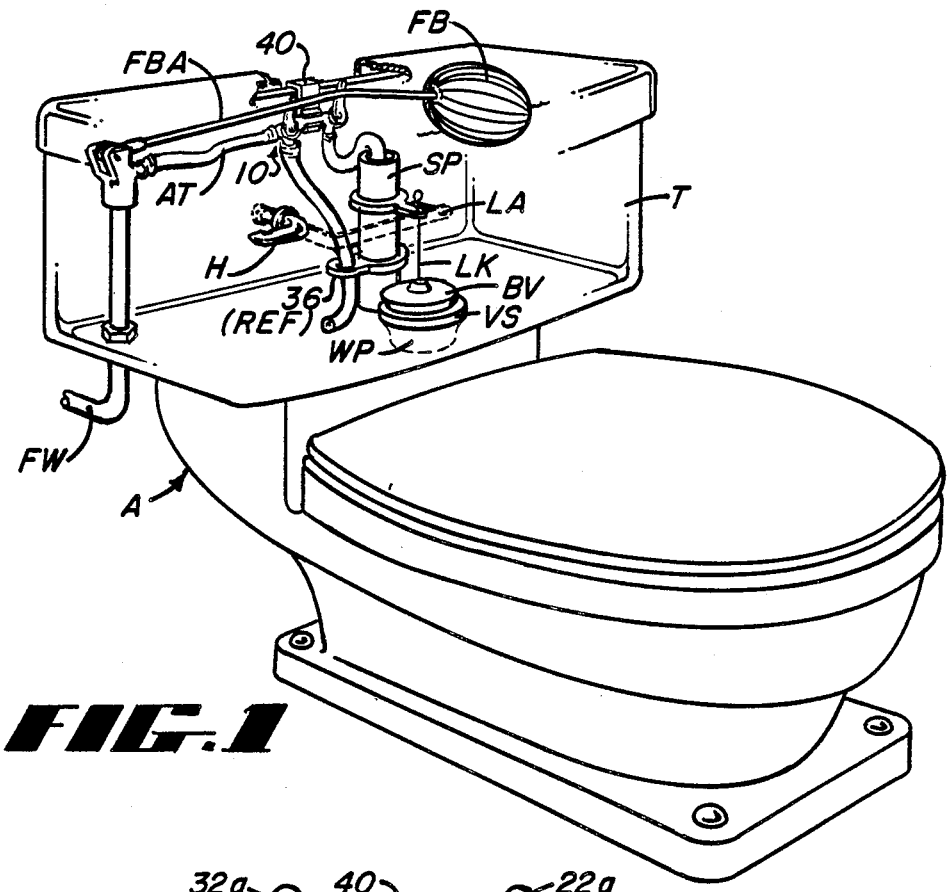
FIG. 1 is a side view, in partial section, of a conventional holding tank provided with the inventive flow splitting assembly.
Figure 2:
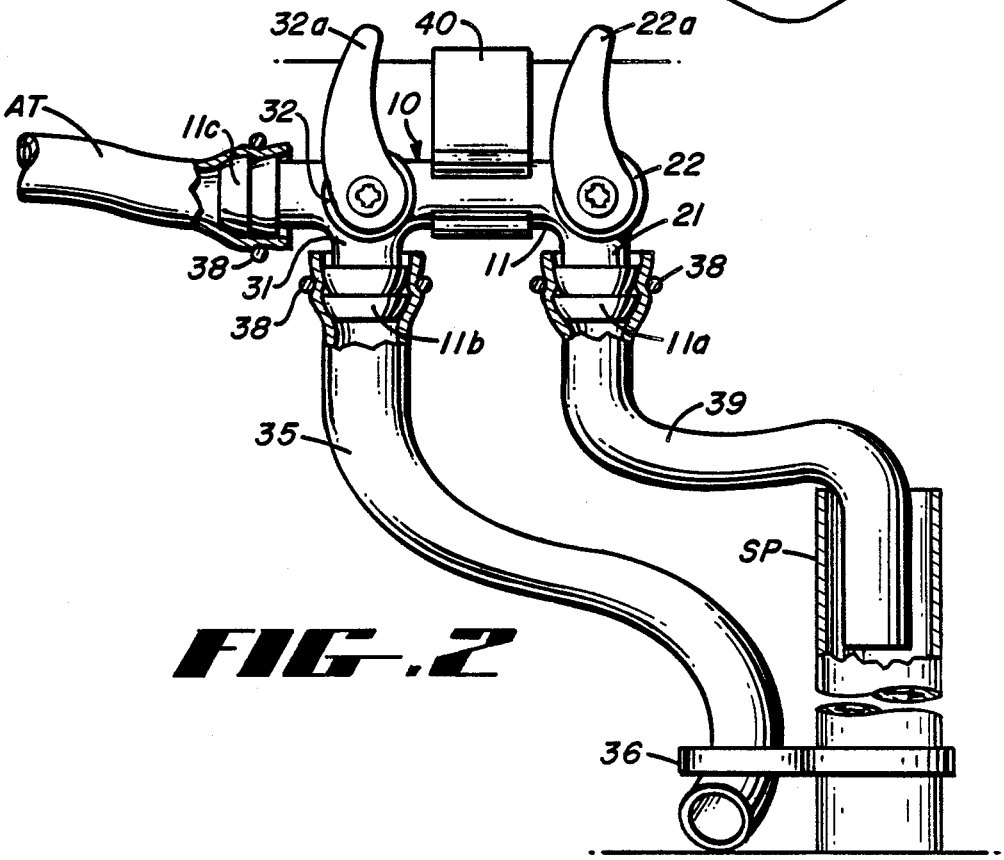
FIG. 2 is a side view detail, in partial section, of the inventive flow splitting assembly shown in FIG. 1.

As shown in FIGS. 1 and 2 a conventional holding tank T of a toilet assembly A includes a valve seat VS provided with a standpipe SP and closed by a ball valve BV. Typically, a handle H on the exterior of the tank T manipulates a lever arm LA which, through a linkage LK, unseats the ball valve from the seat. The water then collected in the tank then drops through a water passage WP into the toilet bowl upsetting the water balance on a water seal trap (not shown). Once thus upset the resulting waterflow in the bowl carries away the matter collected. This cascade across the water sealing trap is designed for full effectiveness and thus will remove all or most of the fluids then contained.

Consequently, following each flushing cycle it is necessary to refill the toilet bowl at a slow rate to restore the necessary fluid of effective liquid seal.

Heretofore the refilling of the toilet bowl has been done in common with the recharging of the storage tank with water. Typically, this has been done by providing a float operated ballcock assembly FBA in the tank which connects to a fresh water pipe FW. A float ball FB on the ballcock assembly FBA then follows the water level in the tank T to allow the fresh water to resupply the tank. A part of that freshwater flow is then diverted through an afterfill tube AT into the standpipe SP to refill the toilet bowl. This flow rate, of necessity, must be rather slow but must be in sufficient quantity to insure a full and complete liquid seal.

Those skilled in the art will appreciate that the flow rate through the afterfill tube depends largely on the local fresh water pressure. This flow rate continues during the raising stroke of the float. Thus, more or less water is delivered to the toilet bowl, depending on the supply pressure, and no mechanisms are provided for the adjustment thereof.

For these reasons it is devised herein to install an aftermarket flow splitting system 10 comprising a Tee fitting 11 defined by two spaced fitting ends 11*a* and 11*b* and orthogonal end 11*c*. A plastic clip-on holder 40 suspends the fitting from one edge of the tank T. Each of the fitting ends may be shaped or formed for convenient connection, e.g., in the manner of a barbed male shape which is conveniently insertable into tubing such as the afterfill tube AT. The tubular legs of the Tee fitting 11 terminating in ends 11*a* and 11*b*, and designated herein as tube segments 21 and 31 respectively, are each provided with a manually operable valve assembly 22 and 32. Each valve assembly, in turn, includes a lever handle 22*a* and 32*a* for manual adjustment. Thus the linear portion of fitting 11 takes the general form of a gang valve comprising two valves 22 and 32. The end 11*b* of the fitting may then be inserted into a tubing segment 35 provided with a clip 36 engageable to any structure of the ballcock or standpipe for directing a part of the stream therethrough. End 11*c* may then be barb fitted into the end of tube AT which is first cut or severed for such insertion. The remaining end fitting 11*a* is then inserted into a tube 39 which continues into the stand pipe SP while end 11*b* receives a controlled afterfill flow. The tube ends may then be cinched by tube clamps 38.

Once thus fitted into the toilet assembly and retained therein by the holder 40 the fitting may be adjusted for the respective flow rates into the standpipe and into the tank. This local adjustment then matches the local supply pressure levels with the water quantity necessary to fill the toilet seal. Thus little or no excess afterfill fluid enters the toilet with the remainder returned to the holding tank.

Obviously many modifications and changes may be made to the foregoing description without departing from the spirit of the invention. It is therefore intended that the scope of the invention be determined solely on the claims appended hereto.

What is claimed is:

1. In a water closet including a storage tank, a ballcock valve connected to admit a selected quantity of water into said tank, a standpipe, and an afterfill tube connected between said ballcock valve and said stand pipe, the improvement comprising:

a tee fitting characterized by a first, second and third end interposed in said after fill line by inserting said first and third ends into corresponding first and second portions thereof;

a first and second adjustable valve respectively formed adjacent said first and third end of said fitting;

a tubing segment connected between said second end and said tank; and holding means for selectively securing said fitting to said tank.

2. Apparatus according to claim 1 wherein:

said first, second and third ends are each conformed in the manner of a barbed insert.

3. Apparatus according to claim 1 wherein:

said tubing segment is secured to the exterior of said stand pipe.

* * * * *